United States Patent [19]

Umino et al.

[11] 4,437,891

[45] Mar. 20, 1984

[54] OIL-ATOMIZED LOW-ALLOY STEEL POWDER

[75] Inventors: Masahide Umino, Nara; Eijiro Tamura, Hirakata; Isamu Karasuno, Yamato-Kooriyama; Minoru Ichidate, Ohtsu; Toshihiko Kubo, Chiba, all of Japan

[73] Assignee: Sumitomo Metal Industries, Ltd., Osaka, Japan

[21] Appl. No.: 350,565

[22] Filed: Feb. 22, 1982

[30] Foreign Application Priority Data

Feb. 24, 1981 [JP] Japan ..... 56-26476

[51] Int. Cl.[3] ..... B22F 1/00; C22C 38/12; C22C 38/22

[52] U.S. Cl. ..... 75/251; 75/0.5 C; 75/123 J; 75/125; 75/126 R; 75/126 C

[58] Field of Search ..... 75/0.5 C, 251, 126 C, 75/123 J, 125, 126 R; 148/16

[56] References Cited

U.S. PATENT DOCUMENTS

| | | | |
|---|---|---|---|
| 4,124,377 | 11/1978 | Larson | 75/0.5 C |
| 4,234,168 | 11/1980 | Kajinaga et al. | 266/137 |
| 4,266,974 | 5/1981 | Nitta et al. | 75/126 C |
| 4,385,929 | 5/1983 | Ichidate et al. | 264/12 |

*Primary Examiner*—Peter K. Skiff

*Attorney, Agent, or Firm*—Burns, Doane, Swecker & Mathis

[57] ABSTRACT

An oil-atomized low-alloy steel powder having improved compressibility, compactibility and hardenability is disclosed. The steel powder has the chemical composition: C: no greater than 0.02%, Mn: 0.3–2.0%, oxygen: no greater than 0.10%, one or more of Cr: 0.1–2.0%, Mo: 0.05–1.0%, Ni: 0.1–2.0%, Cu: 0.2–2.0%, V: 0.03–0.5% and Nb: 0.05–0.5%, and the balance substantially iron.

10 Claims, 4 Drawing Figures

OIL-ATOMIZED LOW-ALLOY STEEL POWDER

This invention relates to an oil-atomized powder of low-alloy steel (hereunder "oil-atomized low-alloy steel powder") and to a method of producing it, said powder having improved compressibility, compactibility and hardenability and being useful in manufacturing powder metallurgical articles.

Powder metallurgical articles made from such a starting material as iron powder, alloy steel powder, etc. include automobile parts, machine components, bearings, friction material parts and so on. The powder metallurgical process is advantageous in that with it these powder metallurgical articles can be mass-produced with high dimensional accuracy, so it has widely been employed in the automotive and machine engineering industries, for example, and the use of the process has remarkably been increased recently.

In the art of powder metallurgy, therefore, a lot of work is being done to manufacture powder metallurgical articles having strength and toughness higher than those of the conventional ones in order to further widen the application of the articles produced by the process. These purposes can be attained by the provision of steel powder having improved compressibility, campactibility and hardenability.

The conventional low-alloy steel powders include an expensive Ni-Mo steel powder such as AISI 4600 (0.2%Mn-2.0%Ni-0.5%Mo) and a slightly less expensive Cr-Mo steel powder such as AISI 8600 (0.8%Mn-0.5%Ni-0.5%Cr-0.2%Mo). However, there is no powder that has improved compressibility and compactibility as well as improved hardenability. These properties are not always satisfied with the conventional material at the same time. For example, one has improved compressibility and compactibility, but the hardenability thereof is poor.

The object of this invention is to provide an inexpensive low-alloy steel powder and a method of producing it, said powder having improved compressibility and compactibility as well as improved hardenability.

The inventors of this invention have carried out a series of experiments and studied the influence of oxygen and carbon on compressibility, compactibility and hardenability, and have found that restriction of carbon and oxygen content to no greater than 0.02% and to no greater than 0.15%, respectively, can result in a low-alloy steel powder having improved compressibility, compactibility and heat treatment properties (e.g., hardenability) to reach this invention.

Furthermore, one of the conventional methods of producing metal powder is water atomization in which water is used as an atomizing medium. However, since a low-alloy steel contains chromium, manganese, etc., which are easily oxidized, the resulting powder contains a relatively large amount of oxygen. The amount of oxygen can not be reduced to a level of below 0.2% even if a reduction process is applied for a prolonged period of time at a high temperature after atomization. On the other hand, the carbon content can be reduced to a very low level during the stage of preparation of molten steel before atomization. However, it is quite difficult to reduce both carbon and oxygen content simultaneously in this case, too.

As a method of further reducing the oxygen content, it has recently been proposed to add carbon to molten steel prior to atomization. The added carbon serves as a reducing agent in accordance with the reaction: $C+O=CO$ during the reduction stage in vacuo.

Japanese Patent Laid-Open Specification No. 100308/1977 (disclosed to the public Aug. 23, 1977) and No. 62101/1980 (disclosed to the public May 10, 1980), for example, disclose water atomization for producing low-alloy steel powder containing carbon in an amount of 0.05% or less and oxygen in an amount of 0.25% or less after reduction. However, this method has the following disatvantages: (i) this method requires heating the powder at a relatively high temperature (1400° C. max.) in vacuo, and the resulting powder is very expensive, (ii) the addition of carbon in excess of the amount required for reduction is necessary, and part of the thus added carbon usually remains in the powder after reduction, and (iii) a steel powder containing 0.010%C and 0.124% oxygen can be obtained, but the green density of the resulting steel powder is 6.62 g/cm$^3$ (compacting pressure 5 tons/cm$^2$), which is relatively low. As long as water atomization is employed, the formation of oxides on the particle's surface is inevitable. It is supposed that since the thus formed oxide is very hard, the reduction of the total oxygen content to a relatively low level as shown in the above does not result in an increase in compact density.

On the other hand, the inventors of this invention have proposed an oil-atomization for the production of iron powder (not low-alloy steel powder), in which an oil is used as an atomizing agent. The employment of an oil as an atomizing agent has made it possible to reduce the oxygen content to an ultra-low level in an iron powder. See U.S. Ser. No. 275,506 (filed June 19, 1981) U.S. Pat. No. 4,385,929.

In this respect, the oil atomization itself is already disclosed in U.S. Pat. No. 4,124,377, though it does not disclose anything special about the importance of carbon and oxygen content in a low-alloy steel powder, nor does it disclose anything about low-alloy steel powder.

According to the above-mentioned oil-atomization, it is possible to reduce the oxygen content to less than 0.15%, usually to less than 0.10%. The inventors of this invention found that an oil-atomized low alloy steel powder in which the carbon and oxygen contents are restricted to no greater than 0.02% and no greater than 0.15%, respectively, after decarburization has a green density as high as 6.8 g/cm$^3$ or more, usually 6.9 g/cm$^3$ or more.

However, it is necessary to reduce the carbon content without oxidizing other alloying elements such as Cr, Mn and Nb, which are usually incorporated in a low-alloy steel and are quite easily oxidized. After a series of experiments the inventors found that it is possible with advantages to provide a low-alloy steel powder with a carbon content reduced to an ultra-low level during decarburization without resulting in the oxidization of alloying elements such as Cr, Mn and/or Nb by effecting the decarburization of the atomized powder under specified conditions including the presence of hydrogen to arrive at this invention.

Figure 1:
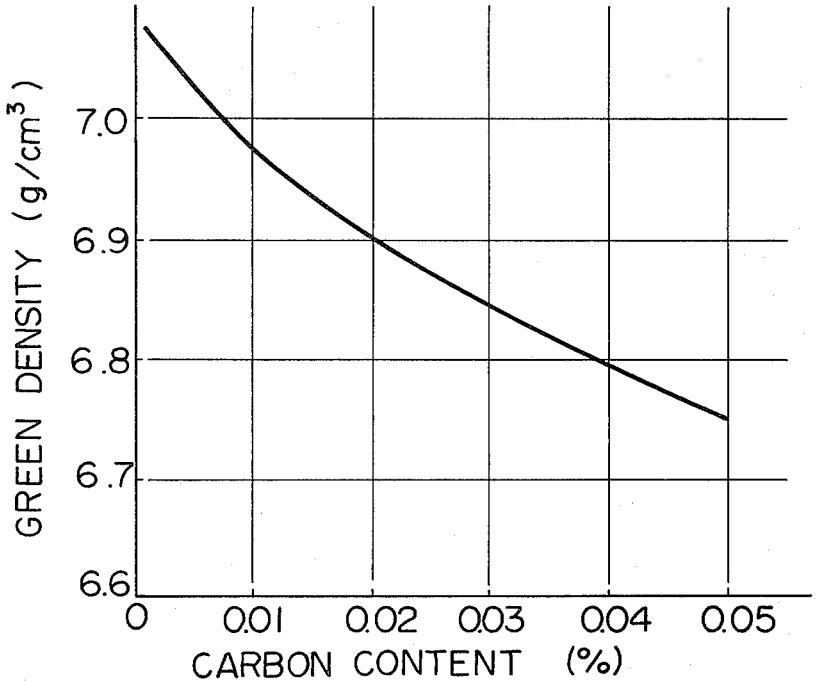
FIG. 1 is a graph showing the relationship between the green density and carbon content of low-alloy steel powder of this invention.

Thus, this invention resides in an oil-atomized low-alloy steel powder having improved compressibility and compactibility as well as improved hardenability, the chemical composition of which after decarburization is:

C: no greater than 0.02%,
Mn: 0.3–2.0%,
Oxygen: no greater than 0.15%
one or more of Cr: 0.1–2.0%, Mo: 0.05–1.0%, V: 0.03–0.5%, Nb: 0.05–0.5%, Ni: 0.1–2.0% and Cu: 0.2–2.0%,
the balance being substantially iron, said powder having a green density of 6.8 g/cm$^3$ or more and a Rattler value of 1.0% or less when the powder is blended with 0.8% of zinc stearate as a lubricant and is compacted at a pressure of 5 ton/cm$^2$.

This invention also resides in a method of producing an oil-atomized low-alloy steel powder as defined above, which comprises preparing an oil-atomized low-alloy steel powder and then applying decarburization in a hydrogen-containing atmosphere at a temperature of 550° C. to 1250° C., preferably 750° C. to 1250° C. The hydrogen-containing atmosphere may by 100% hydrogen atmosphere, or an atmosphere containing an inert gas as well as hydrogen in an amount sufficient to maintain a reducing atmosphere, or an atmosphere containing steam in an amount satisfying the requirement: $P_{H2}O/P_{H2}=0.1$ or less, preferably 0.04 or less.

Usually the carbon and oxygen content of the low-alloy steel powder of this invention is no greater than 0.02% and no greater than 0.10%, respectively, and the green density thereof is 6.9 g/cm$^3$ or more.

A preferred steel composition of this invention is:

C: 0.02% or less,
Mn: 0.5–1.8%,
Cr: 0.5–1.5%,
Oxygen: 0.15% or less, more preferably 0.10% or less,
the balance being substantially iron.

Mo in an amount of 0.1–0.5% may be added thereto.

Thus, this invention is characterized in that oxygen which is easily combined with Mn or Cr to form oxides resulting in deterioration in hardenability and strength of a sintered product is reduced to an ultra-low level and that carbon content which has an adverse influence on green density is also reduced to an ultra-low level. Thus, according to this invention, when the resulting powder is compacted at a pressure of 5 ton/cm$^2$, the resulting compact has a green density of 6.8 g/cm$^3$ or more, usually 6.9 g/cm$^3$ or more, which is much higher than that of the conventional alloy steel powder. Thus, according to this invention, it is possible to provide powder metallurgical articles with a high strength and toughness.

The oil employed in the oil-atomization of this invention may be a mineral oil, or an animal or vegetable oil, or a non-polar solvent. Water, an alcohol, an ester, etc. may be added to the oil in an amount of about 20% or less as a prohibiting agent against carburization.

Since according to this invention, oil-atomization is employed to produce steel powder, a certain degree of carburization during atomization is inevitable even if the carburization-prohibiting agent is added to the oil atomizing medium. Therefore, it is necessary to apply decarburization to the thus atomized steel powder after atomization. In a preferred embodiment of this invention, the decarburization is carried out by heating the oil-atomized powder in an atmosphere containing hydrogen at a temperature of 550° C. to 1250° C., preferably 750° C. to 1250° C. At a temperature higher than 1250° C., welding of particles occurs so much that it is quite difficult to disintegrate the welded particles after decarburization even through a stamping mill, for example, resulting in a decrease in the proportion of fine particles to the total amount of the resulting steel powder. The presence of a certain proportion of fine particles is necessary for a powder metallurgical purpose. On the other hand, at a temperature lower than 550° C., the diffusion rate of carbon in steel is so much low that decarburization does not occur even in a decarburizing atmosphere.

Regarding the decarburizing atmosphere, it may comprise hydrogen in an amount necessary to maintain the atmosphere to be effective for decarburization, usually in an amount of about 20% by volume or more. The remainder is comprised of an inert gas such as $N_2$, Ar or the like.

The decarburization will be promoted by adding steam to the atmosphere to adjudt the ratio of $P_{H2}O/P_{H2}$ to be 0.1 or less, preferably 0.04 or less. When the ratio is higher than 0.1, a substantial degree of oxidation occurs. It is advisable to proceed with decarburization until a substantial degree of oxidation begins to take place.

It is herein to be noted that it is not necessary to add steam to the atmosphere when atomization has been carried out by using an oil-atomizing medium containing the carburization-prohibiting agent, because it is possible to obtain an atomized powder with a reduced amount of carbon content without effecting decarburization in this case.

The reason why the steel composition of this invention is defined as hereinbefore mentioned will be described below.

Carbon: Carbon is an interstitial solid solution former for steel and is effective to strengthen a ferritic matrix. In compacting the steel powder with a die in accordance with the powder metallurgical process, the higher the green density the higher the mechanical strength of the resulting sintered product. Therefore, it is desirable to reduce the content of carbon to as low a level as possible. In order to obtain a green density of 6.8 g/cm$^3$ or more, usually 6.9 g/cm$^3$ or more, the carbon content should be lowered to 0.02% or less.

Oxygen: Oxygen has an influence on green density and compactibility and also on heat treatment properties such as carburizing ability and hardenability of the resulting sintered products. The lower the oxygen content, the better. In order to provide a homogenous metal structure, the restriction of oxygen content to 0.15% or less, preferably 0.10% or less is necessary.

Manganese: Manganese is essential to improve hardenability of the resulting sintered products. The presence of Mn up to 0.3% does not provide any substantial effect. On the other hand, when Mn is added in an amount of over 2.0%, an austenitic phase is retained at room temperature upon cooling, and deterioration in green density is inevitable. Preferably Mn is added in an amount of 0.5–1.8%.

Chromium: Chromium is an element effective to improve hardenability. When added, it is necessary to incorporate it in an amount of 0.1–2.0%, preferably 0.5–1.5% in order to avoid the retained austenitic phase upon cooling and deterioration in green density upon compaction.

Molybdenum: Molybdenum is effective to improve hardenability. It is also effective to improve the temper resistance and to strengthen the resistance to temper brittleness. Mo in an amount of less than 0.05% has no substantial effect. The upper limit of Mo is 1.0%, because Mo is expensive and the presence of a large amount of Mo results in a decrease in green density. Preferably, Mo is added in an amount of 0.1–0.5%.

Nickel: Nickel improves toughness as well as hardenability. When it is added in an amount of less than 0.1%, there is no substantial effect and when it is added in an amount of more than 2.0%, a decrease in green density is inevitable.

Copper: Copper improves hardenability. It is also effective for precipitation hardening due to the precipitation of an alloy phase. When copper is incorporated in an amount of less than 0.2%, there is no substantial effect of copper addition. On the other hand, when it is added in an amount of more than 2.0%, then the compressibility deteriorates.

Regarding the additive elements: Cr, Mo, Ni and Cu, at least one of them may be incorporated in the steel composition of this invention low-alloy steel powder.

Vanadium, Niobium: Vanadium and Niobium are effective to improve strength due to the precipitation of carbides. At least one of these elements may be incorporated in the steel composition of this invention in addition to or instead of the foregoing additive elements of Cr, Mo, Ni and Cu. The presence of less than 0.03% and 0.05%, respectively, of V and Nb is not effective for the intended purpose, while the green density decreases when they are added in amounts of more than 0.5%, respectively.

This invention will be further described in conjunction with some working examples of this invention.

After atomization, oil was removed and the resulting atomized powders were subjected to decarburization under the conditions mentioned below to provide a low-alloy steel powder with ultra-low carbon and oxygen content:

Decarburizing conditions:

Atmosphere:

$H_2$—72.8 vol%, $H_2O$—2.9 vol%, $N_2$—24.3 vol%, $P_{H2}O/P_{H2}=0.03$

900° C.×10 min, steam addition

For the purpose of comparison, AISI 4600 and AISI 4100 steel powders available on the market were used and the steel composition of them are also shown in Table 1.

Green density and Rattler value were determined on these low-alloy steel powders in accordance with JSPM Standard 1-64 (compressibility test for metal powder) and JSPM Standard 4-69 (Rattler test on compactibility for metal powder). The green density is the one obtained when the powder is mixed with 0.8% of zinc stearate as a lubricant and then compacted at a pressure of 5 ton/cm$^2$. The test results are summarized in Table 1.

The Rattler value is defined by the ratio of weights of a test piece before and after the attrition test:

$$\text{Rattler value } (\%)=(A-B/A)\times 100(\%)$$

wherein A is the weight before testing, and B is that after testing.

As is apparent from the data shown in Table 1, both the green density and Rattler value are improved markedly in comparison with those of the conventional steel powders in all the low-alloy steel powders of this invention.

TABLE 1

| Powder No. | Chemical Composition (wt %) C | Si | Mn | P | S | Ni | Cr | Mo | V | Nb | O | N | Cu | Apparent density (g/cm$^3$) | Compact Properties: Green density (g/cm$^3$) | Compact Properties: Rattler value (%) |
|---|---|---|---|---|---|---|---|---|---|---|---|---|---|---|---|---|
| This invention | | | | | | | | | | | | | | | | |
| 1 | 0.009 | 0.01 | 1.87 | 0.013 | 0.014 | — | 0.35 | — | — | — | 0.058 | 0.0013 | — | 2.98 | 7.02 | 0.60 |
| 2 | 0.005 | 0.01 | 0.83 | 0.012 | 0.014 | — | 1.08 | 0.22 | — | — | 0.070 | 0.0009 | — | 2.86 | 6.96 | 0.56 |
| 3 | 0.014 | 0.01 | 1.44 | 0.010 | 0.013 | — | 1.10 | — | — | — | 0.073 | 0.0011 | — | 3.03 | 6.99 | 0.67 |
| 4 | 0.016 | 0.01 | 1.58 | 0.017 | 0.015 | — | — | — | 0.36 | — | 0.089 | 0.0010 | — | 3.05 | 7.03 | 0.48 |
| 5 | 0.003 | <0.01 | 1.60 | 0.008 | 0.016 | — | — | — | — | 0.29 | 0.086 | 0.0008 | — | 2.97 | 7.00 | 0.37 |
| 6 | 0.011 | 0.02 | 0.66 | 0.007 | 0.014 | 0.47 | 0.98 | 0.21 | — | — | 0.038 | 0.0015 | — | 3.05 | 6.92 | 0.71 |
| 7 | 0.008 | <0.01 | 1.40 | 0.015 | 0.011 | 0.96 | — | 0.16 | — | — | 0.044 | 0.0013 | 0.47 | 3.01 | 6.91 | 0.64 |
| 8* | 0.013 | <0.01 | 0.86 | 0.019 | 0.018 | — | 1.02 | 0.25 | — | — | 0.097 | 0.0001 | — | 3.13 | 6.94 | 0.72 |
| Conventional | | | | | | | | | | | | | | | | |
| 9 | 0.006 | 0.01 | 0.21 | — | — | 1.81 | 0.03 | 0.49 | — | — | 0.170 | 0.0028 | — | 3.09 | 6.68 | 1.32 |
| 10 | 0.14 | 0.02 | 0.85 | — | — | 0.02 | 1.06 | 0.25 | — | — | 0.097 | 0.0066 | — | 3.16 | 6.59 | 0.78 |

NOTE:
*Example 2

EXAMPLE 1

Low-alloy steel powders the chemical composition of which is shown in Table 1 below were prepared. The steel powders of this invention were produced under the following conditions:

Atomization: Oil-atomization

Molten steel temperature: 1680° C.

Atomizing agent: Quenching oil, 160 l/min

Atomizing pressure: 150 kg/cm$^2$

The particle size distribution of steel powders Nos. 1 through 10 is summarized in Table 2 below. As long as the particle size distribution falls within these ranges, there is no substantial scatter with respect to green density and Rattler value.

TABLE 2

| Mesh | 60/100 | 100/145 | 145/200 | 200/250 | 250/350 | −350 |
|---|---|---|---|---|---|---|
| % | 5–10 | 13–18 | 25–30 | 12–17 | 20–25 | 10–15 |

EXAMPLE 2

In this example, a low-alloy steel powder the chemical composition of which is shown in Table 1 as Powder No. 8 was prepared under the following conditions:

Atomizing conditions:

Atomization: Oil-atomization

Molten steel temperature: 1650° C.

Atomizing agent: Machine oil+5 vol% water, 350 l/min

Atomizing pressure: 200 kg/cm$^2$

Decarburizing conditions:

Atmosphere: hydrogen 100 vol%

Decarburization: 1000° C.×30 min.

Green density and Rattler value were determined as in Example 1 on the resulting steel powder. Test results are also shown in Table 1 as Powder No. 8.

EXAMPLE 3

In this example, the effect of carbon content on green density was determined.

An oil-atomized low-alloy steel powder having the following basic composition was prepared in accordance with the procedures of Example 1. The carbon content was varied within the range between 0.005% and 0.05%.

TABLE 3

| Chemical Composition (wt %) | | | | |
|---|---|---|---|---|
| C | Mn | Cr | Mo | Oxygen |
| 0.005–0.05 | 0.83 | 1.08 | 0.22 | 0.07 |

The resulting powders were blended with 0.8% of zinc stearate (lubricant) and then compacted at a pressure of 5 ton/cm$^2$ to determine the green density.

The resulting relationship between green density and carbon content of low-alloy steel powder is shown in FIG. 1. Since the oxygen content is lower than 0.10%, the resulting green density was more than 6.9 g/cm$^3$, when the carbon content is 0.02% or less. Usually, when the oxygen content is no greater than 0.15%, the green density is 6.8 g/cm$^3$ or more for the carbon range of 0.02% or less.

EXAMPLE 4

In this example, the relationship between green density and compacting pressure was determined.

The steel powder having the chemical composition shown in Table 4 below was prepared in accordance with Example 1. For comparison, Steel Powder Nos. 9 and 10 in Table 1 were used. Zinc stearate (0.8%) was used as a lubricant.

Figure 2:
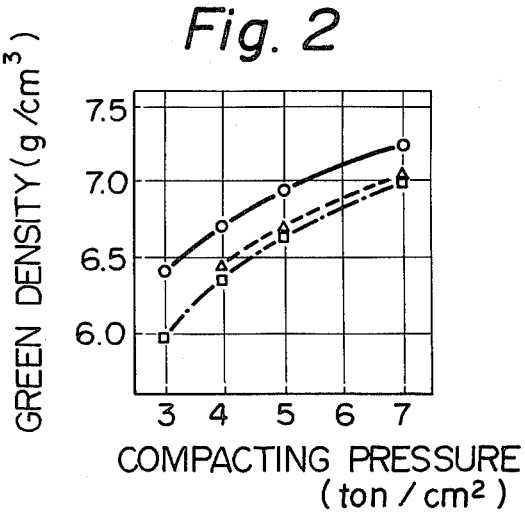
FIG. 2 is a graph showing the relationship between green density and compacting pressure.

The results are summarized in FIG. 2 in which the symbol "0" indicates this invention, and "Δ" and "□" indicate Steel Nos. 9 and 10, respectively. The green density of the low-alloy steel powder of this invention is always higher than that of the conventional ones.

TABLE 4

| Chemical Composition (wt %) | | | | |
|---|---|---|---|---|
| C | Mn | Cr | Mo | Oxygen |
| 0.005 | 0.70 | 0.87 | 0.26 | 0.080 |

EXAMPLE 5

In this example, the effect of oxygen content on hardenability was determined.

An oil-atomized low-alloy steel powder having the following basic steel composition was prepared by repeating Example 1. The oxygen content was varied within the range between 0.038% and 0.635%.

TABLE 5

| Chemical Composition (wt %) | | | | |
|---|---|---|---|---|
| C | Mn | Cr | Mo | Oxygen |
| 0.005 | 0.83 | 1.08 | 0.22 | 0.038–0.635 |

Each of the resulting powders was blended with graphite powder in an amount necessary to adjust the carbon content of the sintered specimen to be 0.25% and zinc stearate as a lubricant (0.8%) and was compacted into a rod 25 mm in diameter at a compacting pressure of 5 ton/cm$^2$.

The resulting green compacts were sintered for one hour at a temperature of 1150° C. in a hydrogen atmosphere. The sintered compacts were then subjected to carburization, quenching and tempering. That is, the sintered specimens were first maintained in a carbon-containing atmosphere (carbon potential 0.9%) at 920° C. for 3 hours, then oil-quenched and heated at 180° C. for 2 hours to effect tempering.

The carbon content of the matrix after sintering was 0.25%. The resulting specimens in the rod-shape were examined with respect to micro-Vickers hardness in the vicinity of surface area in section.

Figure 3:
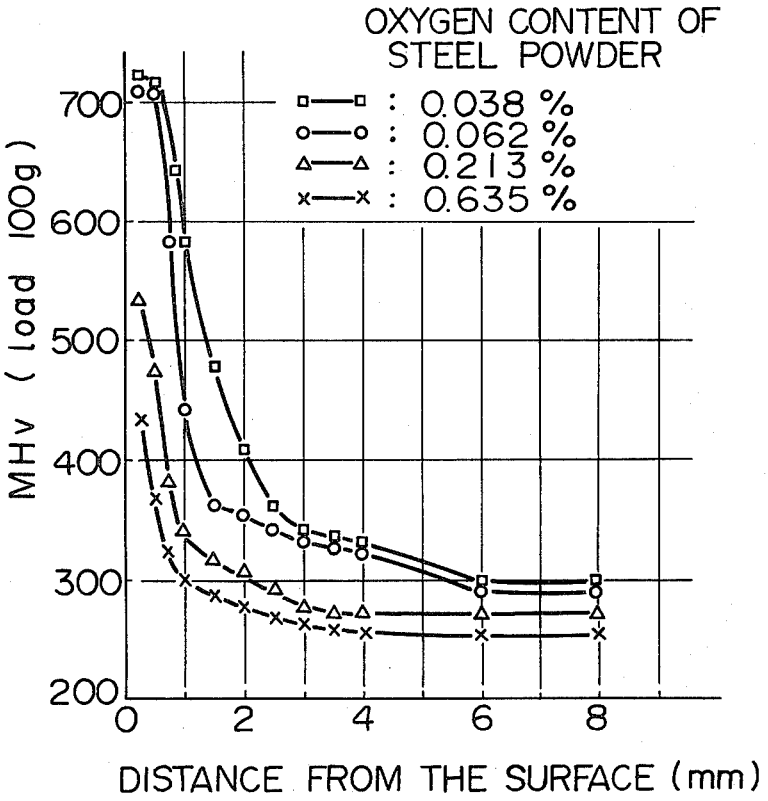
FIG. 3 is a graph obtained by plotting the values of micro-Vickers hardness with respect to the distance from the surface.

The test results are summarized in FIG. 3. As is apparent from the data shown in FIG. 3, the hardenability deteriorates as the content of oxygen in low-alloy steel powder increases. Particularly, when the oxygen content is over 0.15%, i.e. in case the oxygen content is 0.213% and 0.635%, the hardness in the vicinity of surface area is markedly decreased. This is because carbon does not diffuse into the surface area due to the presence of a relatively large amount of oxygen in that area.

EXAMPLE 6

In this example, the relationship between the carbon content and tensile strength of a sintered product was determined. Low-alloy steel powder No. 2 in Table 1, which is one of steel powders of this invention, and conventional powder No. 10 in Table 1 were compacted at a compacting pressure of 5 ton/cm$^2$, while changing the amount of graphite to be added to the powder so that the carbon content of a sintered product varied within the range of 0.2% and 0.8%. Zinc stearate was used as a lubricant.

Specimens for tensile test were prepared in accordance with JSPM Standard 2–64. The tensile test was applied after sintering the specimens for one hour at a temperature of 1150° C. in a hydrogen atmosphere.

Figure 4:
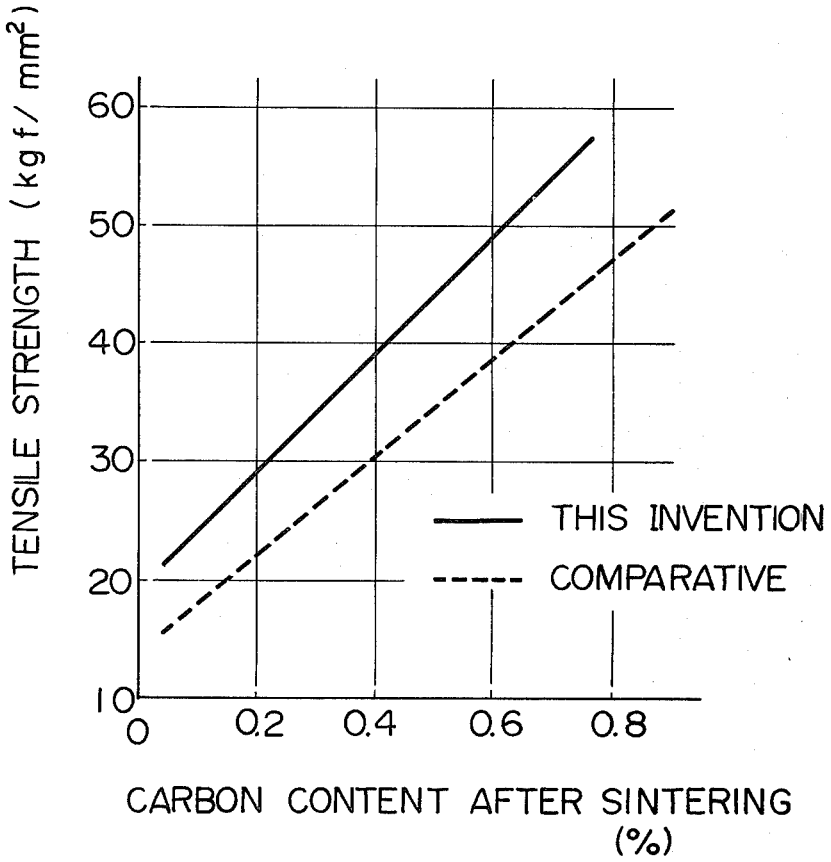
FIG. 4 is a graph showing the relationship between tensile strength and carbon content.

Test results are shown in FIG. 4. It is noted from FIG. 4 that the tensile strength of the sintered product made from the steel powder of this invention is 10–20 kg/mm² higher than that of the sintered product made from the conventional steel powder. This is because that the conventional steel powder contains a relatively large amount of carbon and has a green density smaller than that of the steel powder of this invention.

In addition, hardenability was determined on test pieces (C=0.5%) after quenching and tempering. That is, test pieces with a carbon content of 0.5% were heated at a temperature of 870° C. for one hour, oil-quenched, then kept at a temperature of 180° C. for 2 hours and air-cooled. Tensile test was also applied to the resulting test pieces. Test results are shown in Table 6 below.

As is apparent from the data shown therein, since the density after sintering is high, the tensile strength of the sintered product made from the steel powder of this invention is 10 kgf/mm² higher than that of the conventional. The elongation is also remarkable in case of this invention.

TABLE 6

| Steel Powder | Sintering-Quenching-Tempering | Density after sintering (g/cm³) | Tensile strength (kgf/mm²) | Elongation (%) |
|---|---|---|---|---|
| No. 2 (this invention) | 1150° C. × 1 hr in $H_2$ → 870° C. × 1 hr → Oil-quenching → 180° C. × 2 hr → Air cooling | 7.1 | 83.5 | 3.4 |
| No. 10 (conventional) | | 6.7 | 72.4 | 1.3 |

As is apparent from the foregoing, since the oil-atomized low-alloy steel powder of this invention contains ultra-low amounts of carbon and oxygen, the powder may have a high green density upon compression and also have improved hardenability. Therefore, according to this invention, it is possible to manufacture powder metallurgical articles having a high strength and toughness, making it possible to widen the application to machine parts which require a strength much higher than that obtained in the prior art.

What is claimed is:

1. An oil-atomized low-alloy steel powder having improved compressibility, compactibility and hardenability, the chemical composition of which after decarburization is:
C: no greater than 0.02%,
Mn: 0.3–2.0%,
Oxygen: no greater than 0.10%,
one or more of
Cr: 0.1–2.0%, Mo: 0.05–1.0%,
Ni: 0.1–2.0%, Cu: 0.2–2.0%,
V: 0.03–0.5% and Nb: 0.05–0.5%,
the balance substantially iron,
the powder having a green density of 6.9 g/cm³ or more and a Rattler value of 1.0% or less when the powder is mixed with 0.8% of zinc stearate as a lubricant and then is compacted at a pressure of 5 ton/cm².

2. An oil-atomized low-alloy steel powder as defined in claim 1, in which the steel composition is:
C: no greater than 0.02%, Mn: 0.3–2.0%,
Oxygen: no greater than 0.10%,
one or more of
Cr: 0.1–2.0%, Mo: 0.05–1.0%,
Ni: 0.1–2.0% and Cu: 0.2–2.0%,
the balance substantially iron.

3. An oil-atomized low-alloy steel powder as defined in claim 1, in which the steel composition is:
C: no greater than 0.02%, Mn: 0.3–2.0%,
Oxygen: no greater than 0.10%,
one or more of V: 0.03–0.5% and Nb: 0.05–0.5%,
the balance substantially iron.

4. An oil-atomized low-alloy steel powder as defined in claim 1, in which the steel composition is:
C: no greater than 0.02%, Mn: 0.3–2.0%,
Oxygen: no greater than 0.10%,
one or more of
Cr: 0.1–2.0%, Mo: 0.05–1.0%,
Ni: 0.1–2.0% and Cu: 0.2–2.0%,
one or more of
V: 0.03–0.5% and Nb: 0.05–0.5%,
the balance substantially iron.

5. An oil-atomized low-alloy steel powder as defined in any of claims 1, 2 or 4, in which the steel composition is:
C: no greater than 0.02%, Mn: 0.5–1.8%,
Oxygen: no greater than 0.10%,
Cr: 0.5–1.5%,
the balance substantially iron.

6. An oil-atomized low-alloy steel powder as defined in claim 5, which further comprises 0.1–0.5% of Mo.

7. An oil-atomized low-alloy steel powder as defined in any of claims 1 to 4, which has been subjected, after atomization, to decarburization at a temperature of 550° C. to 1250° C. in a hydrogen-containing atmosphere.

8. An oil-atomized low-alloy steel powder as defined in claim 7, in which the decarburization is carried out at a temperature of 750° C. to 1250° C.

9. An oil-atomized low-alloy steel powder as defined in claim 7, in which the decarburization is carried out in an atmosphere containing hydrogen and steam under such conditions that the ratio $P_{H_2O}/P_{H_2}$ is 0.1 or less.

10. An oil-atomized low-alloy steel powder as defined in claim 9, in which the ratio $P_{H_2O}/P_{H_2}$ is 0.04 or less.

* * * * *